US005450970A

United States Patent [19]

Mitchell

[11] Patent Number: 5,450,970

[45] Date of Patent: Sep. 19, 1995

[54] COMB AND HAIRBRUSH HOLDER

[76] Inventor: Lyndol W. Mitchell, 135 Rio Dr., Crescent City, Calif. 95531

[21] Appl. No.: 249,334

[22] Filed: May 27, 1994

[51] Int. Cl.[6] ..... A47B 81/02; A47F 5/08

[52] U.S. Cl. ..... 211/65; 211/89

[58] Field of Search ..... 211/13, 65, 89, 124, 211/66; 132/120, 213.1; 15/160; 4/606

[56] References Cited

U.S. PATENT DOCUMENTS

| | | | |
|---|---|---|---|
| 3,109,177 | 11/1963 | Grafmyer | 4/158 |
| 3,346,901 | 10/1967 | Fay | 15/160 |
| 3,980,608 | 9/1976 | Faltersack | 248/37.3 |
| 4,325,484 | 4/1982 | Berry | 211/66 |
| 4,936,469 | 6/1990 | Drower | 211/69.8 |
| 4,943,018 | 7/1990 | Glaser et al. | 248/110 |
| 4,945,598 | 8/1990 | Racioppi | 15/160 |
| 5,005,710 | 4/1991 | Hofer | 211/70.6 |
| 5,072,904 | 12/1991 | Taylor | 248/110 |

FOREIGN PATENT DOCUMENTS

| | | | |
|---|---|---|---|
| 366021 | 12/1922 | Germany . | |
| 262689 | 12/1926 | United Kingdom | 132/120 |

*Primary Examiner*—Leslie A. Braun
*Assistant Examiner*—Catherine S. Collins
*Attorney, Agent, or Firm*—Michael I. Kroll

[57] ABSTRACT

A planar plate or block has extending support bristles into which the teeth of a comb or the bristles of a hairbrush may be inserted at random positions or orientations. The bristles are arranged in a tightly packed relationship so as to augment the compressive force on an object slipped between them. Also the support bristles are preferably formed flexible material with a high coefficient of friction so as to provide a high frictional support force. The bristle support plate is detachably mounted upon another plate which is suitable for mounting on nearly any flat external surface such as a wall or the bottom of a drawer.

2 Claims, 2 Drawing Sheets

COMB AND HAIRBRUSH HOLDER

CROSS REFERENCE TO RELATED DISCLOSURE DOCUMENT

This invention was disclosed in Information Disclosure Document No. 331,331, filed with the United States Patent and Trademark Office on May 3, 1993.

BACKGROUND OF THE INVENTION

1. Field of the Invention

The present invention relates to a comb and hairbrush holder and organizer for convenient storage and organization of a number of combs and hairbrushes. More specifically, it relates to a bristle-type holder which frictionally engages the teeth or bristles of a comb or brush, respectively. More generally the bristle holder may be used to support and organize any thin elongated objects as required in various work environments. For example the bristle holder of this invention might prove useful to support envelopes in a mail room or nails in a carpentry shop.

Thus it can be seen that the potential fields of use for this invention are myriad, and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

The storage and organization of combs and hairbrushes has always presented a problem in bathrooms, dressing rooms, and other relatively small rooms. The cramped quarters in these areas makes limited countertop space crowded and inconvenient. Combs and brushes themselves do not occupy a large amount of volume and tend to be strewn about in travel kits, drawers, medicine chests, or on countertops. In large families the considerable number of combs and brushes belonging to various family members tend to get mixed up and lost. The prior art in this area has been searched at the U.S. Patent and Trademark Office. The following patents were uncovered. As will be seen, the simplicity and effectiveness of my invention is not rivaled in the prior art.

Faltersack U.S. Pat. No. 3,980,608, issued on Sep. 14, 1976, shows a knife rack which self-adjusts to blade thickness. The patent does not disclose bristles as a holding medium. Also, the patent does not allow for variable side-to-side positioning of the knives as they must be inserted into one of the available slots. By contrast, my invention uses bristles and allows for the supported articles to be placed at any random position at any orientation.

Berry U.S. Pat. No. 4,325,484, issued on Apr. 20, 1982, shows a holder for elongated articles. The patent does disclose bristles as the holding medium but the bristles are oriented differently from my unique construction. The facing bristle construction of the patent does not allow for variable side-by-side positioning of several articles as it is primarily designed to support a single article. By contrast, the device of the instant invention uses bristles emanating from a substantially planar surface and allows the supported articles to be placed at any random position at any orientation.

Hofer U.S. Pat. No. 5,005,710, issued on Apr. 9, 1991, shows a retaining device for tools, writing instruments, and the like, which is made from a slitted foam block. The patent does not disclose bristles as a holding medium. Also, the patent does not allow for variable side-to-side positioning of the knives as they must be inserted into one of the available preexisting slits. By contrast, my invention uses bristles and allows for the supported articles to be placed at any random position at any orientation.

Drower U.S. Pat. No. 4,936,469, issued on Jun. 26, 1990, shows a storage rack for small articles comprising a series of resilient retainer loops. The patent does not disclose bristles as a holding medium. Also, the patent does not allow for variable side-to-side positioning of the knives as they must be inserted into one of the available pre-existing slits. By contrast, my invention uses bristles and allows for the supported articles to be placed at any random position at any orientation.

It will be noted that all the prior art devices require the supported articles to be positioned in fixed and predetermined positions with respect to one another. This causes problems of supporting and accessing numerous items of widely varying shapes and sizes. Also, they are all designed to receive a rigid portion of the supported article, such as a handle. These limitations of the prior art make it inappropriate to support combs by their teeth or brushes from their bristles as contemplated by my invention.

None of the above inventions and patents, taken either singly or in combination, is seen to describe the instant invention as claimed.

SUMMARY OF THE INVENTION

Briefly, the invention comprises a planar plate or block with normally extending support bristles into which the teeth of a comb or the bristles of a hairbrush may be inserted at random positions or orientations. The bristles are arranged in a tightly packed relationship so as to augment the compressive force on an object slipped between them. Also the support bristles are preferably formed from a flexible material with a high coefficient of friction so as to provide a high frictional support force. The bristle support plate is detachably mounted upon another plate which is suitable for mounting on nearly any flat external surface.

Accordingly, it is a principal object of the invention to provide a new and improved comb and hairbrush holder which overcomes the disadvantages of the prior art in a simple but effective manner.

It is a major object of this invention to provide a holder which permits support of numerous objects placed in random positions and orientations.

It is another object of the invention to provide such a holder which may be mounted easily upon nearly any vertical or horizontal surface.

It is another object of the invention-to provide such a holder which requires no modification or special design of the objects to be supported and organized.

It is another object of the invention to provide such a holder which may be easily removed from its main support structure to allow for easy cleaning.

It is another object of the invention to provide such a holder which also provides ring supports for additional articles.

It is another object of the invention to provide such a holder which requires no special manipulation of the supported article for attachment to the holder.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
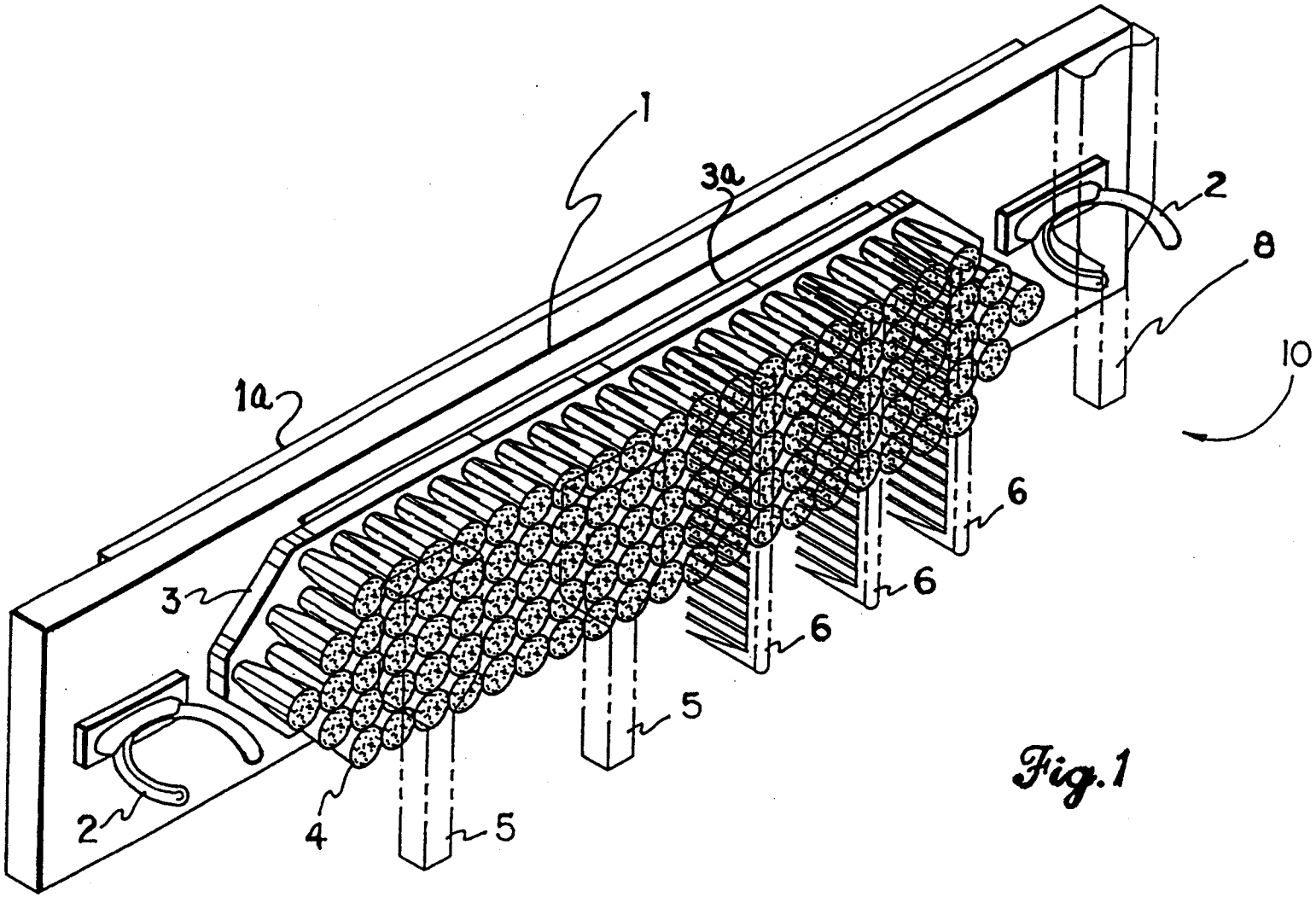
FIG. 1 is a perspective view of the invention with several supported combs and brushes shown in phantom lines.

The invention is indicated generally in FIG. 1 by arrow 10. Main support block 1 is generally rectangular and adapted to be attached on its rear face 14 (FIG. 3) to any convenient flat environmental surface. It is contemplated that the environmental surface could be vertical, as a wall, or horizontal, as a drawer bottom or countertop. The attachment means preferred for main support block 1 is a peel-off adhesive 1*a* for ease and convenience. However, many other conventional semi-permanent attachment means will occur to the artisan and could be used. Main support block 1 is shown as a plain rectangular block for simplicity of illustration only and it is contemplated that appropriate scrolls, curves, and other decorative details might easily be incorporated to enhance the aesthetic appearance. Near each end of the front face of main support block 1 are mounted ring hooks 2. Ring hooks 2 have forwardly facing openings and are of a relatively conventional design. Hooks 2 may be rigidly attached to or integrally formed with main support block 1. Hooks 2 can be used to support a solid object such as shown at 8 or to hang a loosely formed object such as a towel or washcloth. Since the bristle support portion of the instant invention is especially suited to support combs and hairbrushes, it is contemplated that hooks be dimensioned so as to support other commonly available hair care products such as hair spray and the like. This overall organization would thus provide a convenient single storage location for hair related needs.

Removably mounted on the front face of main support block 1 is a support bristle device comprising flat bristle support plate 3 with a plurality of bristle clusters 4 extending therefrom. Each cluster is made up of a plurality of individual bristles in the conventional manner found on commercially available scrub brushes. The individual bristles are preferably rough in surface texture so as to enhance their frictional gripping ability. The individual bristles are densely packed so that a large number of them will be simultaneously bent when a foreign object is inserted between them. The exact arrangement of bristle clusters 4 on support plate 3 may be in vertically aligned rows and columns as shown primarily for drawing simplicity or offset and staggered if desired. Bristle clusters 4 are referred to in total as bristles 7 in FIGS. 2 and 3. Bristles 7 extend outwardly from the front face of plate 3 in the same direction as ring hooks 2 extend from the front face of main support block 1.

Figure 3:
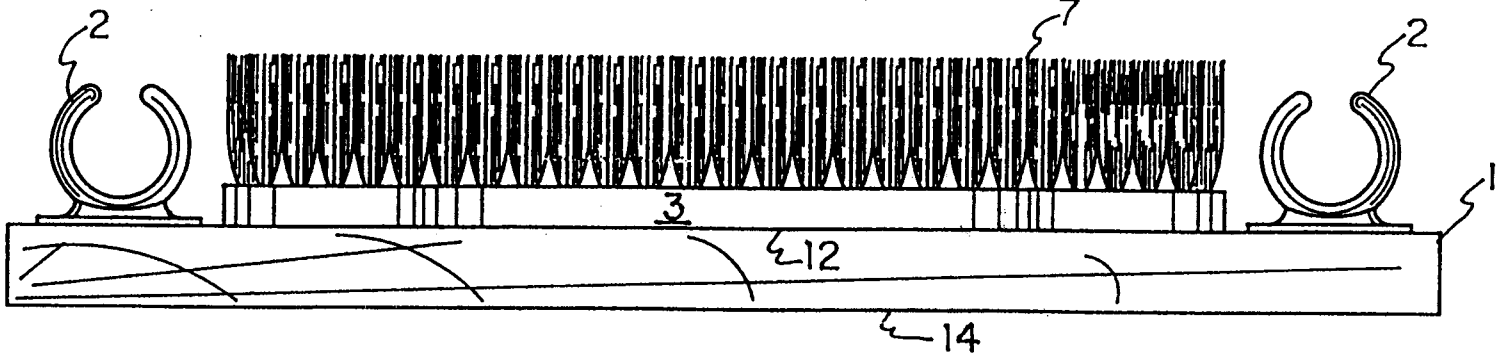
FIG. 3 is a side view of the invention showing the detachable support face between the bristle block and the main support block.

The flat rear face of plate 3 rests flush against the flat front face of main support block 1 along face 12 of FIG. 3. These two faces are arranged to be removably attached to one another as by some type of conventional face-to-face fastening means. Artificial briar material such as VELCRO 32 might be used as might some sort of durable non-hardening adhesive. Also, flat magnets could be used for this purpose. If desired, recessed hooks (not shown) or other more exotic removable fasteners might be used. The bristle structure being removable from the main support structure is desirable for the purpose of cleaning or replacing the bristle structure periodically.

Figure 2:
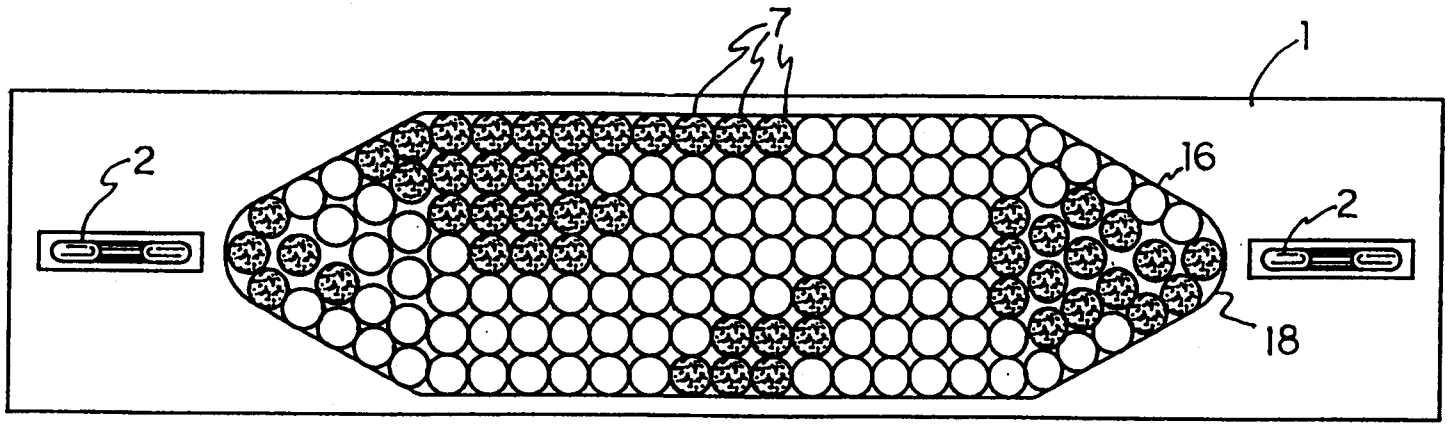
FIG. 2 is a plan view of the invention as seen looking directly at the ends of the support bristles and showing the arrangement of the bristle clusters.

FIG. 2 illustrates the overall arrangement of bristles 7 as being thick in the middle and tapered toward each end as shown at 16. The extreme ends of the group of bristles 7 are rounded as at 18. This arrangement allows a greater number of bristles to contact an object placed near the center of the bristle pack than at the ends 18. It is contemplated that heavier brushes would thus be placed near the center of the device while relatively small items, such as moustache comb could be placed near the ends. If a very heavy item is to be supported it may be angled across the bristles so as to be supported by an even greater number of bristles.

To use the invention, the teeth portion of a comb, such as shown at 6 in FIG. 1, need only be gently pressed against the support bristles 7 at any position or orientation. If it is desired to support a hair brush, such as shown at 5 in FIG. 1, the brush bristles need only be gently pressed against the support bristles 7 at any position or orientation. Wider objects may be supported from one of the ring hooks 2.

A list of reference numerals for the first embodiment of the present invention follows:

10 comb and hairbrush holder
1 main support block
2 ring hook
3 bristle support plate
4 individual bristle cluster
5 hairbrush
6 comb
7 bristles in general
8 bathroom accessory
12 face between support block and plate
14 rear face of support block
16 tapered end of bristle pattern

18 rounded end of bristle pattern

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily see that tools and/or other various and sundry items could be supported and organized with the instant invention.

It is to be understood that the present invention is not limited to the sole embodiment described above, but encompasses any and all embodiments within the scope of the following claims:

I claim:

1. A holder and organizer for securing a comb or hairbrush thereto comprising:

a main support block having a front and rear face with means for attaching said rear face to an external support surface;

a support bristle plate having a forward face and a back face;

a plurality of closely spaced elongated bristles extending from said forward face of said bristle plate;

releasable attachment means holding said front face of said support block flush with said back face of said bristle plate;

said comb or hairbrush adapted to be supported frictionally by said bristles when inserted into said bristles;

said bristles being arranged in a pattern on said bristle plate which pattern is substantially as wide as said support block near the center thereof and which tapers down toward the ends thereof so as to provide a relatively thick bristle pattern at the center and a relatively thinner bristle pattern toward the ends so that a relatively heavier hairbrush can be supported at the center than at the edges of said pattern; and said main support block having opposite end portions extending beyond the ends of said bristle support plate and said main support block having a means mounted on at least one of said end portions of said support block for supporting an additional article.

2. The holder and organizer of claim 1 in which said means for supporting an additional article is a ring hook.

* * * * *